US007297042B2

(12) United States Patent
Whitehead

(10) Patent No.: US 7,297,042 B2
(45) Date of Patent: Nov. 20, 2007

(54) MAGNETIC TOY

(75) Inventor: Brian Whitehead, Vauxhall (GB)

(73) Assignee: Evolve NPD Limited (GB)

( * ) Notice: Subject to any disclaimer, the term of this patent is extended or adjusted under 35 U.S.C. 154(b) by 0 days.

(21) Appl. No.: 10/985,685

(22) Filed: Nov. 11, 2004

(65) Prior Publication Data

US 2005/0112988 A1 May 26, 2005

(30) Foreign Application Priority Data

Nov. 11, 2003 (GB) ..... 0326232.6

(51) Int. Cl.
*A63H 33/26* (2006.01)

(52) U.S. Cl. ..... 446/139; 446/129; 446/131; 446/136; 446/138; 446/268; 446/288; 446/330; 446/376

(58) Field of Classification Search ..... 446/139, 446/129, 130, 131, 132, 134, 135, 136, 137, 446/138, 268, 269, 275, 279, 280, 288, 330, 446/352, 376, 448
See application file for complete search history.

(56) References Cited

U.S. PATENT DOCUMENTS

| | | | | |
|---|---|---|---|---|
| 191,092 | A * | 5/1877 | Bachman | 446/135 |
| 2,036,076 | A * | 3/1936 | Philippl | 446/135 |
| 2,427,442 | A * | 9/1947 | Campbell | 446/132 |
| 3,401,485 | A * | 9/1968 | Goodrum, Jr. | 446/132 |
| 3,867,786 | A * | 2/1975 | Greenblatt | 446/130 |
| 4,155,196 | A * | 5/1979 | Bollinger et al. | 446/130 |
| 4,938,730 | A * | 7/1990 | Yamane et al. | 446/130 |
| 4,993,983 | A * | 2/1991 | Kurita et al. | 446/94 |
| 5,277,643 | A * | 1/1994 | Ejima | 446/93 |
| 5,916,007 | A * | 6/1999 | Maxim | 446/130 |
| 6,471,565 | B2 * | 10/2002 | Simeray | 446/298 |
| 6,547,625 | B2 * | 4/2003 | Whitehead | 446/132 |
| 2001/0041495 | A1 * | 11/2001 | Chan | 446/268 |

FOREIGN PATENT DOCUMENTS

| | | | |
|---|---|---|---|
| EP | 627248 | A2 * | 12/1994 |
| EP | 1 033 159 | A2 | 9/2000 |
| EP | 1 134 011 | A2 | 9/2001 |
| GB | 2 277 882 | A | 11/1994 |

* cited by examiner

*Primary Examiner*—Richard Smith
*Assistant Examiner*—Travis Reis
(74) *Attorney, Agent, or Firm*—McKee, Voorhees & Sease, P.L.C.

(57) ABSTRACT

A toy includes at least two articles. At least one of the articles has a movement or change of condition component which is caused to occur by magnetic attraction between magnets and/or magnetically attractive material via the respective articles when brought into proximity. The movement is created by a drive assembly provided in one of the articles and connected to a magnet or magnetically attractive material such that the movement force can be transferred between the articles via the magnetic attraction.

20 Claims, 5 Drawing Sheets

MAGNETIC TOY

BACKGROUND OF THE INVENTION

The invention which is the subject of this application is an improved and effective use of magnetic means within a toy, said toy being adapted, and shaped, to be attractive to a specific target audience within the general heading of "children". It should therefore be appreciated that the invention as herein described will have a number of different applications and purposes in relation to toys and therefore, although the invention is described with regard to a number of different forms of toys, these in themselves should not be interpreted as being a limiting factor in the interpretation of the scope of the invention.

The use of magnets and/or magnetically attractive material within toys to provide a particular effect in that the toy is well known and indeed, the applicant has a number of granted and pending applications which relate to inventive and novel uses of magnetic material. In the current application, the applicant provides a yet further inventive and novel application of use of magnets and/or magnetic material in the manner as will now be described.

Conventionally, when providing a drive force to a particular item in a toy, there is a need to provide a power source and a motor. The motor, typically provides rotational movement, and is linked either directly to the portion of the toy to be moved or linked via a gear mechanism and/or other drive translation means.

Typically therefore the drive means for a movable portion is provided within the article itself and so, if there is required to be provided a number of articles which can be used in conjunction to form the toy, each of the articles is provided with a drive means assembly. While there have been significant improvements to drive motors, and power sources for the same, the provision of a drive means assembly is still relatively expensive in comparison to the cost of the remainder of the toy and therefore, while it may be desired to provide drive to all or the majority of the articles in a toy, it is frequently the case that the number of articles which have moving portions is limited or restricted due to the cost implications of providing drive means in each of said articles.

The aim of the present invention is to provide a drive force for a number of articles of a toy which means that when the articles are used in conjunction, movement can be imparted from one drive means assembly provided in one of said articles. By achieving this, so the number of drive means which are required to be provided does not need to match the number of articles in which movement is required thereby allowing a reduction in the cost of the article and the toy as a whole while ensuring that the movement is provided as required. This arrangement can also be utilised to provide an unusual and unexpected affect for the child playing with the toy as the article or articles may appear to be moving without any visible or discernible drive source.

In a first aspect of the invention there is provided a toy, said toy including at least two articles, a first article including a drive means assembly therein, said drive means assembly connected to move at least one magnet or a portion of magnetically attractive material at said article, the second article including at least one or magnetically attractive material positioned to allow magnetic attraction between the magnet and magnetically attractive material in the two articles when the articles are brought within a given range characterised in that when there is magnetic attraction, movement of the magnet or magnetically attractive material in one article, causes a change in condition of the said other articles via the movement of the magnet or magnetically attractive material in the other article.

The change in condition can, for example, be a movement of a portion of the article or the completion of a power circuit to cause a power supply to be provided.

Typically, the drive means assembly includes a motor and a power source which can be electronic, or a clockwork mechanism for example. The drive means assembly may be provided to generate movement of the magnet or magnetically attractive material directly or via a gear mechanism of at least one portion in said first article.

In one embodiment the magnet or magnetically attractive material in the said other article, is provided in connection, either directly or via a gearing mechanism with a portion which is movable in said other article.

In an alternative arrangement, the drive means assembly of the first article does not move or change condition of any portion of the said first article but rather acts only as a drive means for said other article(s) via movement of the magnetically attracted magnet or magnetically attractive material in the respective articles.

In one embodiment, the drive means assembly can be provided to provide a moving magnet or magnetically attractive material at a number of locations on said article via linkages at a number of locations such that, when another article or articles is/are positioned in proximity of any of said locations, the movement force can be transferred to said other article.

In one embodiment, the gear mechanism between the drive assembly and the magnet or magnetically attractive material on the first article and/or the gear assembly between the magnet or magnetically attractive material and a movable portion on said other article, can be such so as to alter the torque and/or extent of movement created.

A significant improvement of this application is that the magnetic field between the first and second magnets or magnetic material is transferred at a relatively high speed which means that the torque required for the transfer to be achieved is relatively low. It also means that with suitable gearing at the recipient article of the magnetic transfer the torque can be increased and the speed of rotation slowed down so as to provide the required movement effect at the required movement speed.

In one embodiment, the article within which the drive means assembly is provided is designated as a power source and a range of said other articles can be provided, each of said other articles being provided with a movable portion and/or other change of condition component and a magnet or magnetically attractive material to allow the movement from the power source article to be imparted to the particular selected further article which is brought into proximity with the same. Typically, each of said other articles includes a movable portion but the movable portions differ from article to article thereby allowing a range of different movements to be imparted and allowing the opportunity for selection to be made by the child playing with the toy.

In one embodiment, the drive means assembly in the first article is linked to a number of locations at which there is supplied a magnet or magnetically attractive material which is provided to move under the influence of the drive means and a number of other articles are provided to be selectively positioned with respect to said first article at said locations thereby allowing, firstly, the user the option to choose and position said other articles as and when they require and also for said movement to be transferred to said other article.

In one embodiment, a movement effect is provided which is linked to the appearance of said first or further article and/or the location of said further article with respect to the first article.

In one embodiment drive means assembly includes a drive control means which is movable between engaged and disengaged positions, at least the movement in one in one of the directions typically caused by the influence of the magnetic attraction between the two articles.

BRIEF DESCRIPTION OF THE DRAWINGS

Specific embodiments of the invention are now described with reference to the accompanying drawings, wherein.

DETAILED DESCRIPTION OF THE PREFERRED EMBODIMENT

Figure 1:
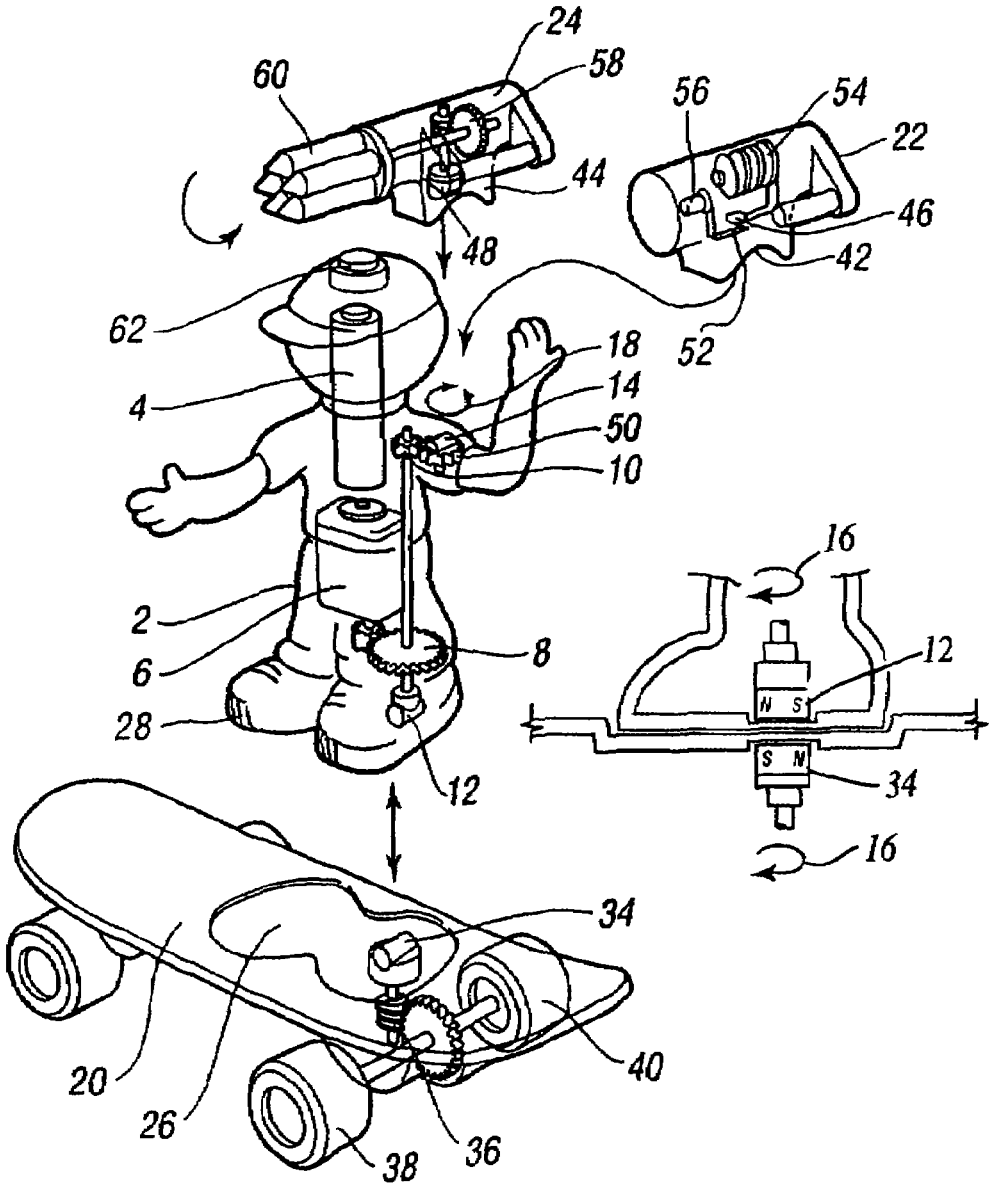
FIG. 1 illustrates in schematic fashion, a first embodiment of the invention.

Referring firstly to FIG. 1, there is illustrated a toy comprising, and shown in section, a first article 2, in the form of a model of a boy and within said first article there is provided a drive assembly in the form of a power source 4, linked to a motor 6. The motor 6 is in turn linked via gear assemblies 8, 10, to, in this embodiment, magnets 12, 14 respectively. Each of the magnets 12, 14 is mounted so as to be rotatable as indicated by arrows 16, 18 respectively.

Also provided as part of the toy is a further article 20 in the form of a skateboard, a further article 22 in the form of a light and a further article 24 in the form of a gun. The skateboard 20 is provided with a location means 26 for the location of the "feet" 28 of the first article 2. As will be seen, located under the skateboard base 32 is a further magnet 34 also provided for rotation. This magnet is then connected via the gear arrangement 36 to the rear wheels 38, 40 of the skateboard.

Thus, when the drive means assembly is operated the magnet 12 in the first article 2 is rotated, and when the article feet 28 are placed onto the skateboard 20 location 26, the magnets 12, 34 in the respective articles are sufficiently close together so as to be attracted by magnetic force. As the magnet 12 in the article 2 is rotating and driven to do so, so the movement is transferred to rotate the magnet 34 in the skateboard. As a result, the wheels 38, 40, linked by the gear arrangement 36 are moved. This therefore gives the impression to a child and an onlooker that the skateboard is moving under its own influence as the child knows that they have not switched on any power source or drive means on the skateboard itself.

Turning now to the other articles 22, 24, they are both provided with attachment means 42, 44 and are both provided with magnetic material 46 or a magnet 48. These two articles can be selectively positioned at the location 50 on the first article 2 which is provided with the magnet at that location. Thus, if the article 22 is positioned by the child on the article 2, the magnet 14 is sufficiently close to the magnetically attractive material 46 on the article 22 so as to operate the magnetic switch. The completion of the switch allows, in this embodiment, the completion of an electric circuit 52 which includes power cells 54 as shown. Thus, although in this case power cells are provided in this particular article, they are not provided to cause movement and it is the magnetic attraction between the magnet 14 and the magnetically alternative material 46 which causes the completion of this switch and hence the illumination of the LED 56 within the article to give the impression of a light being switched on when the article is placed on the article 2.

If the article 24 is positioned on the first article 2, then the rotation of the magnet 46 provided on the article 24, via the gear arrangement 58, causes rotation of the barrels 60 of the gun thereby giving a more realistic feature to the same.

The article 2 is also provided with a switch 62 to allow the actuation of the drive means. This switch can be operated in a normal manner. It is obviously important that the orientation of the magnets or magnetically attractive material in the respective articles is correct to allow the required movement to occur and FIG. 1 illustrates one arrangement between the magnet of the first article 2 and the skate board.

Figure 2:
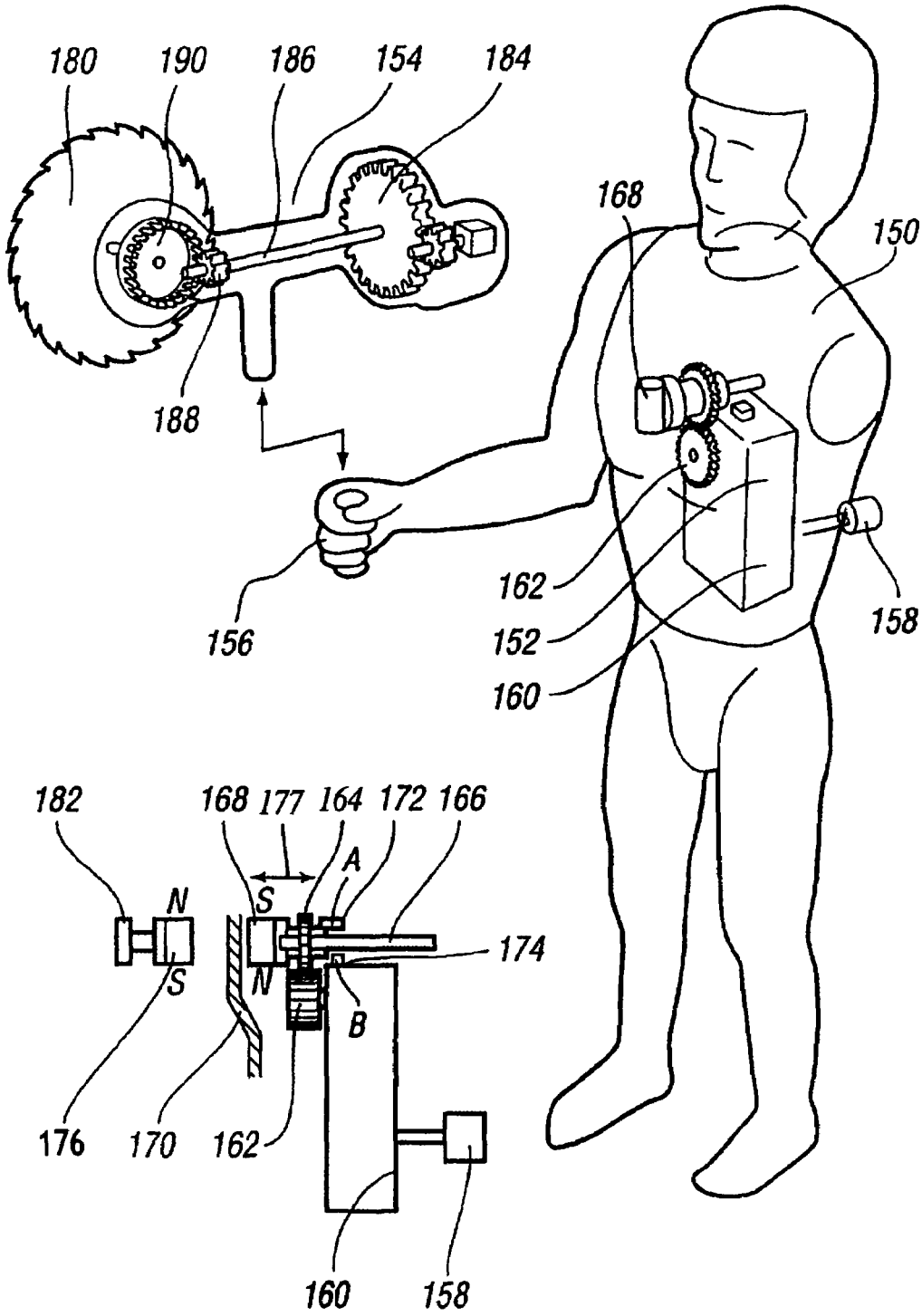
FIG. 2 illustrates a further embodiment of the invention.

FIG. 2 illustrates a variation on the embodiment of FIG. 1 and in this case the article 150 is provided with a drive means assembly 152 and a second article 154 is provided to be attached to the first article via the hand 156. The drive means assembly in this case has a power source in the form of a clockwork mechanism which comprises an external winder 158 connected to a winder mechanism 160 with gear 162 which meshes with a gear wheel 164 mounted on a shaft 166 for rotation. The shaft 166 also has mounted on the same a magnet or magnetically attractive material 168 adjacent the surface 170 of the article 150.

In operation there is provided a drive control means 172 in the form of a tab which is mounted on the shaft and which, when in an engaged position, contacts with a fixed tab 174 mounted on the winding mechanism housing 160. This contact prevents rotation of the shaft and hence rotation of the magnet thus preventing winding down of charged clockwise mechanism of the drive means assembly. However, when the magnet or magnetically attractive material 176 of the article 154 is brought close to the article i.e. when positioned in the hand 156, the attraction between the magnet and/or magnetically attractive materials 168, 176 overcomes the biasing of the drive control means to the engaged position and causes the same to disengage from the fixed tab 174 and face the shaft and allow rotation of the shaft by the winding mechanism. The movement is indicated by arrow 177 and the rotational movement is transferred via the magnetic attraction of the other article such that the clockwork mechanism only rotates and hence can wind down when the other article is in proximity. In this cast the movement created is of the rotatable blade 180 via the linkage from the magnet 176, gearwheels 182, 184, axle 186, and gearwheels 188, 190, all of which only rotate under the influence of the rotation of magnet 168 when magnet attraction is created between the magnets 168 and 176.

Figure 3A:
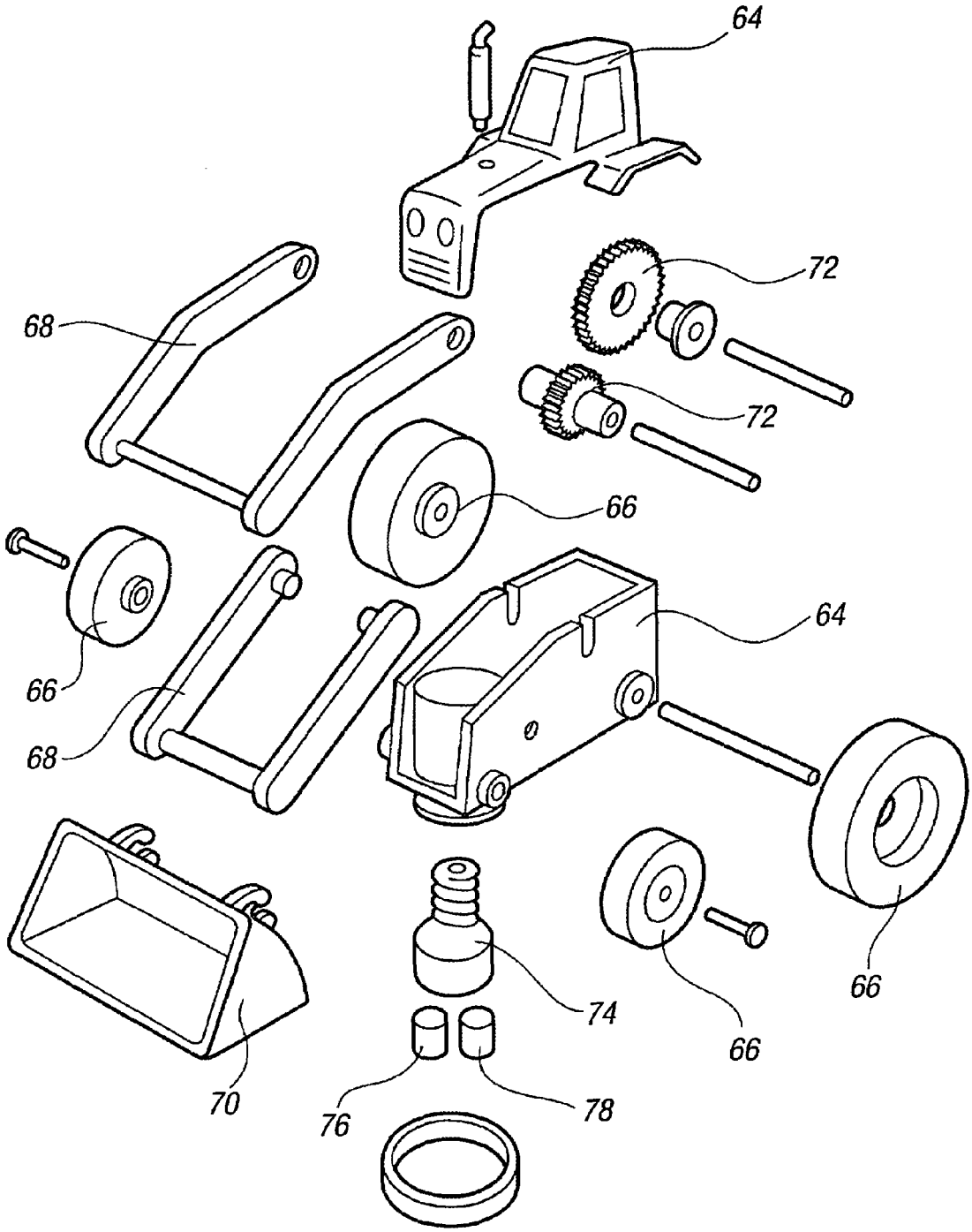
FIGS. 3*a* and *b* illustrate a second embodiment of the invention.
Figure 3B:
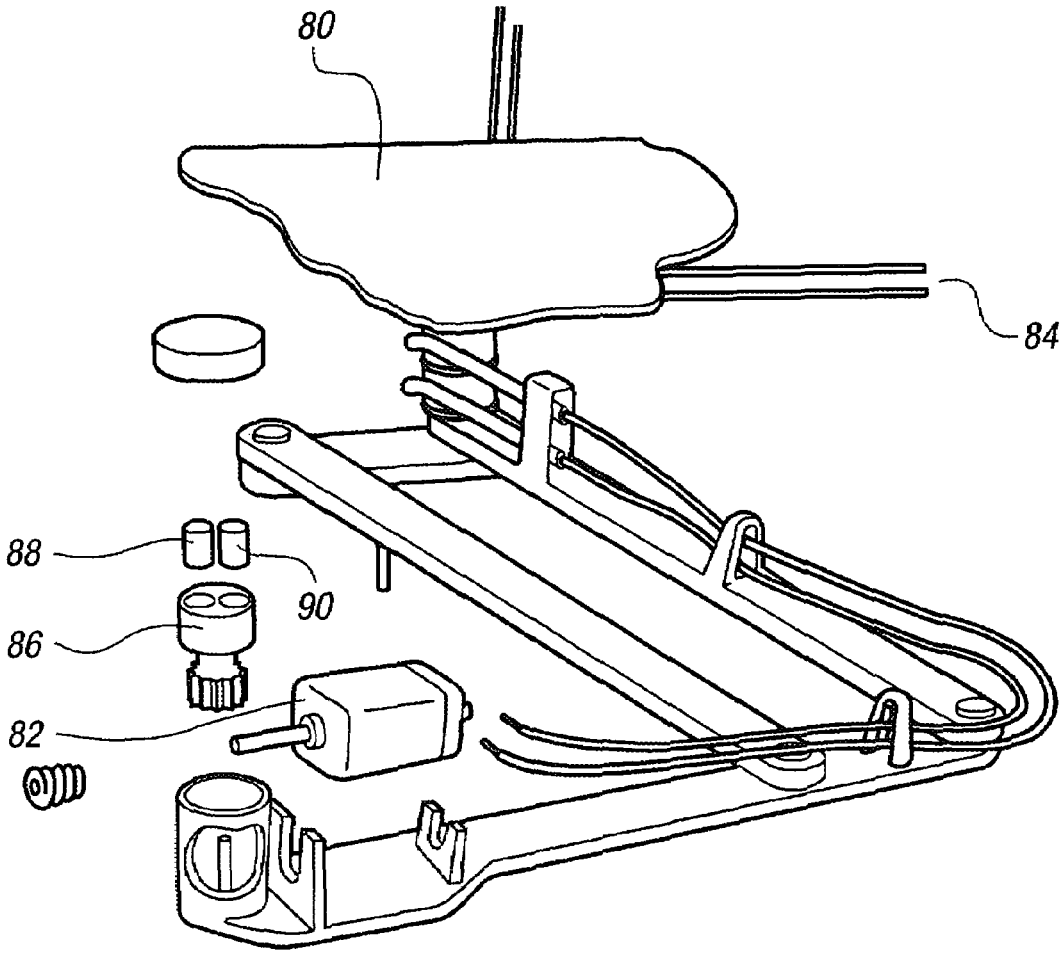

FIGS. 3*a* and *b* illustrate a further embodiment of the invention wherein there is shown the components of a toy excavator in FIG. 3*a*. The toy excavator includes outer housing components 64, wheels 66 and a series of members 68 which are connected to a shovel or bucket 70. The members are linked to a gear mechanism 72 which is provided within the housing and the gear mechanism in turn, is connected to a rotatable spindle 74 within which first and second magnets 76, 78 are mounted. In this case, the first article is in fact a playbase 80 with the drive means assembly provided under the surface in a manner depicted in FIG. 3*b* where the drive assembly comprises a motor 82 connected to a power source 84 and with a rotating housing 86 in which first and second magnets 88, 90 are provided. Typically the first and second magnets provide sufficient strength such that the magnetic field passes through the play base 80 and on which the other article, in this case in the form of the mechanical excavator, is positioned. Also shown is how the housing with the magnets 88, 90 under the surface can be movable about the underside of the surface thereby causing the other article to move across the top side of said surface and the rotational movement of the housing is also attractive to the magnets 76, 78 on the said other article thereby causing movement of the gear mechanism 72 in said article and hence causes the raising and lowering of the shovel or bucket 70 as the article moves across the surface. Thus, in this embodiment, the system provides a first movement component across the surface and then a second movement component of a portion of said article as it moves along the surface.

Figure 4A:
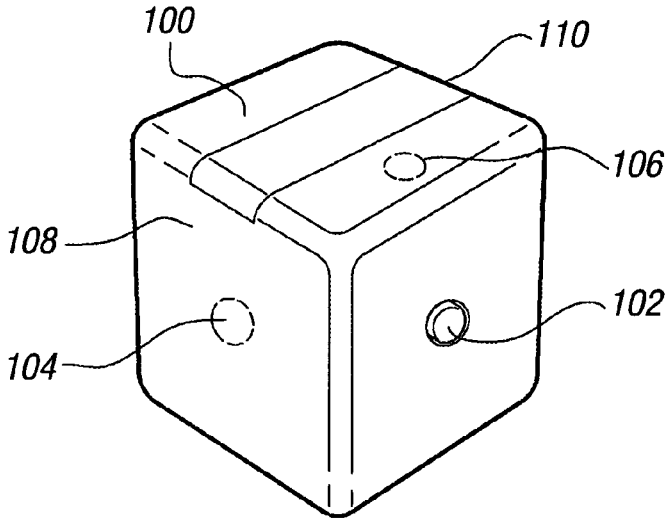
FIGS. 4*a* and *b* illustrate a further embodiment of the invention.
Figure 4B:
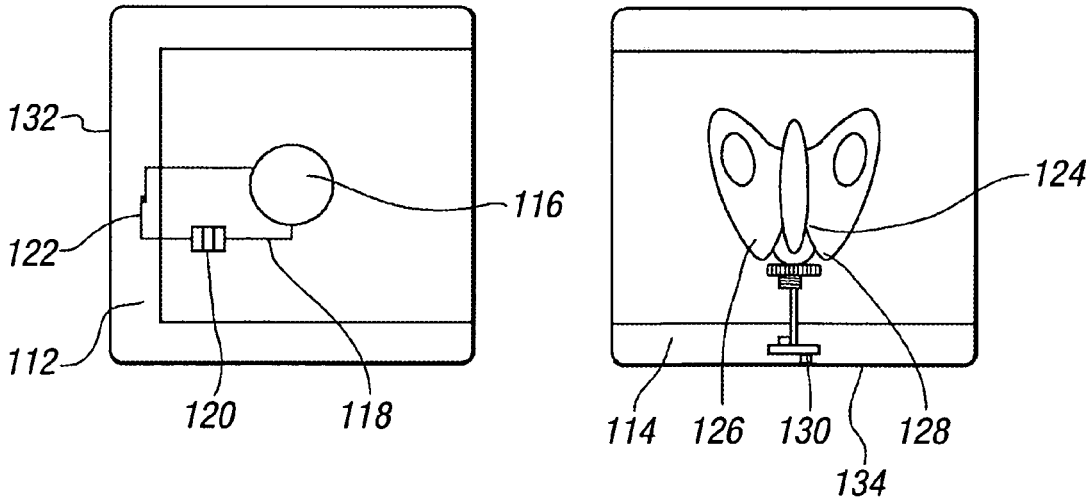

A further embodiment of the invention is described with reference to FIGS. 4*a* and *b*. There are provided a series of blocks, each of said blocks being cuboid in shape. Within the first block 100, there is provided a drive means assembly (not shown) comprising a power source, a drive motor, an activation switch 102 and the drive motor is connected to first and second magnets 104, 106 positioned adjacent the inside face of the side walls 108, 100 respectively. In each of the other blocks 112, 114, as sown in FIG. 4*b*, there is provided a portion, the condition of which changes when an indicated part of said article is brought into proximity with either of the side walls. In block 112 there is provided a light source 116 which is normally off but can be switched on, said light source 116 connected to an electrical circuit 118 and having power cells 120 therein and a magnetically actuated switch 122 and in the other block 114 there is mounted, within a cavity in the same, an article, in this case a butterfly 124, whose wings 126, 128 move when actuated. The wings are connected via a gearing mechanism to a magnet 130 which is mounted for movement in a rotational manner adjacent a side wall of the same. Typically each of said further blocks 112, 114 includes on the outer face of a side wall 132, 134 at which the magnet or magnetically attractive material is mounted, some form of indication which is recognisable by the child so that the child knows to place that particular portion adjacent to the side walls in the said first article. Thus, in one use of the same, the drive means assembly is activated by the actuation by the child of the switch. This causes movement of the magnets at the said side walls and the first further block 112 with a light source 116 therein, is positioned by the child adjacent one of the side walls 108 so that the magnetic switch is put on and the electrical circuit to the power cells completed such that the light source illuminates either continuously, if the magnetic field is sufficient or, if the movement of the magnet within the said first block is over a sufficient distance, the magnetic switch may be placed on and off repeatedly thereby causing the light to flash on and off. At the same time or subsequently, the further block 114, with the butterfly 124, can also be positioned against the other side wall 108, 110 of the said first block in which the further magnet 106 is provided and the movement of that magnet is imparted to the magnet within the block and in turn the movement imparted via the gear mechanism to move the wings 126, 128 of the butterfly.

Although not shown, it is a yet further possibility in any embodiment that sufficient drive can be provided from the article with the drive means assembly to allow movement of a portion of a further article which is placed adjacent thereto and, for movement from said further article to be transferred to a yet further article to allow a further portion to be moved or conditions changed on said article and therefore it will be appreciated that a combination of said articles can be provided to have portions moved and/or conditions changed from a single drive means assembly.

What is claimed is:

1. A toy, comprising:

a first article including a drive means assembly therein, said drive means assembly connected to move a first magnet or a portion of magnetically attractive material at said article, a second article including a second magnet or magnetically attractive material positioned to allow magnetic attraction between the first and second magnets or magnetically attractive materials in the two articles within a given range, and when there is a magnetic attraction, rotational movement of the magnet or magnetically attractive material in one of the articles causes a change in condition of the other article, via the movement of the magnet or magnetically attractive material in the one article, and said articles are independently movable by a user to allow selective movement of the same in and out of said range by the user such that when the articles are moved into said range the change of condition of the said other article is achieved; and wherein the changed condition is rotation of the magnet or magnetically attractive material in one of the articles on the same axis as the rotation of the magnet or magnetically attractive material in the other article.

2. A toy according to claim 1 wherein the change in condition includes a movement of a portion of the second article.

3. A toy according to claim 1 wherein the change in condition includes the completion of a power circuit to cause a power supply to be provided to the drive means assembly.

4. A toy according to claim 1 wherein the drive means assembly includes a motor and a power source and provides movement directly or via a gear arrangement of at least one portion in said first article.

5. A toy according to claim 1 wherein the magnet or magnetically attractive material in the said second article is provided in connection, either directly or via a gearing arrangement, to allow movement of the second magnet or magnetically attractive material.

6. A toy according to claim 1 wherein the drive means assembly acts as a drive means source for said second article.

7. A toy according to claim 1 wherein the drive means assembly provides a moving magnet or magnetically attractive material at a number of locations on said first article via linkages and when the second article is positioned in proximity of any of said locations the movement is transferred to said second article.

8. A toy according to claim 1 wherein a gear mechanism is provided between the drive means assembly and first magnet or magnetically attractive material to alter the torque and/or extent of movement created.

9. A toy according to claim 1 wherein the drive means assembly is used as a power source and the second article is provided with a movable portion and/or other change of condition component to allow movement from the drive means assembly to be imparted to the second article when brought into proximity.

10. A toy according to claim 1 wherein a movement effect is provided which is linked to the appearance of said first or second article and/or location of said second article with respect to the first article.

11. A toy according to claim 1 wherein the drive means assembly includes a drive control means, said drive control means movable between an engaged and disengaged position.

12. A toy according to claim 11 wherein, when in the engaged position, movement of the drive means assembly is prevented and in a disengaged position, the drive means assembly is movable.

13. A toy according to claim 12 wherein movement from the disengaged to the engaged position is caused by a biasing means.

14. A toy according to claim 11 where movement of the drive control means between the engaged and disengaged positions is caused by magnetic attraction.

15. A toy according to claim 14 wherein movement of the drive control means allows the creation of electrical contact to complete a power supply to the drive means assembly.

16. A toy according to claim 11 wherein the movement of the drive control means allows the mechanical disengagement and hence allows rotation of a drive shaft of the drive means assembly.

17. A toy according to claim 11 wherein the drive means assembly is a clockwork drive mechanism.

18. A toy, comprising:

a first article;

a power source in the first article;

a magnet in the first article rotationally coupled to the power source;

a second article; and a magnetically reactive component in the second article;

whereby, activation of the power source rotates the magnet, which magnetically activates the component to impart a changed condition in the second article; and said articles are independently movable by a user to allow selective movement of the same in and out of a given range by the user such that when the articles are moved into said range the changed condition of the second article is achieved; and wherein the changed condition is rotation of the magnetically reactive component in the second article on the same axis as that of the magnet in the first article.

19. The toy of claim 18 wherein the changed conditions includes movement of at least part of the second article.

20. The toy of claim 18 wherein the changed conditions includes illumination in the second article.

* * * * *